United States Patent [19]

Liu

[11] 3,931,057

[45] Jan. 6, 1976

[54] SURFACTANT COMPOSITIONS

[75] Inventor: Shih K. Liu, St. Louis, Mo.

[73] Assignee: Monsanto Company, St. Louis, Mo.

[22] Filed: Dec. 17, 1973

[21] Appl. No.: 425,596

Related U.S. Application Data

[60] Division of Ser. No. 197,504, Nov. 10, 1971, which is a continuation-in-part of Ser. No. 710,644, March 5, 1968, abandoned.

[52] U.S. Cl. ..... 252/551; 252/89; 252/531; 252/532; 252/550; 260/458

[51] Int. Cl.[2] ..... C11D 1/12; C11D 1/68

[58] Field of Search ..... 252/89, 550, 551, 532; 260/458

[56] References Cited

UNITED STATES PATENTS

| | | | |
|---|---|---|---|
| 1,897,741 | 2/1933 | Ulrich et al. | 260/458 |
| 2,241,421 | 5/1941 | Price et al. | 260/513 |
| 2,275,413 | 3/1942 | Bertsch | 260/458 |
| 2,808,442 | 10/1957 | Smith et al. | 260/611 |
| 3,017,437 | 1/1962 | Normant | 260/611 |
| 3,242,200 | 3/1966 | Johnson | 260/398 |
| 3,256,155 | 6/1966 | Cahn et al. | 260/458 |
| 3,607,778 | 9/1971 | Lincoln et al. | 252/353 |

FOREIGN PATENTS OR APPLICATIONS

| | | |
|---|---|---|
| 987,417 | 3/1965 | United Kingdom |

*Primary Examiner*—P. E. Willis, Jr.
*Attorney, Agent, or Firm*—Neal E. Willis; J. E. Maurer; Thomas N. Wallin

[57] ABSTRACT

Alkane vicinal alkyl ether monohydroxyl alcohols are intermediates for production of alkane vicinal alkyl ether sulfates which are effective detergent surfactants.

3 Claims, No Drawings

SURFACTANT COMPOSITIONS

This is a division, of application Ser. No. 197,504, filed Nov. 10, 1971, which is a continuation-in-part of application Ser. No. 710,644, filed Mar. 5, 1968, and now abandoned.

BACKGROUND OF THE INVENTION

This invention relates to novel surfactant intermediates, surfactants and surfactant compositions and to detergent formulations containing such surfactants and compositions.

As is well known in the detergent industry, surfactants are compounds or compositions, which in solution, are effective to remove dirt, soil, stains, etc., from fabrics and various other materials. Such surfactants can be used alone or, more commonly, in combination with various adjuvants, re-enforcers, supplements, augmentors, potentiators and/or benefactors usually referred to as detergency builders which in combination with the surfactant provide formulations of enhanced cleansing ability.

In order to avoid contamination of natural water supplies, it is desirable that a surfactant be biodegradable. Further, from the standpoint of economy and, in some instances, ecological consideration, it is desirable that a surfactant exhibit effective cleaning power in combination with relatively small amounts of builder components. It has been suggested that under some conditions phosphates may contribute to acceleration of eutrophication of bodies of water. Accordingly, in geographical regions where eutrophication problems exist, it may be desirable to utilize non-phosphate builders or builders of reduced phosphate content and suitable surfactants should be effectively "built" by such builders.

Although many surfactants are known, many do not provide effective cleaning function in the absence of high levels of phosphate containing builders, are non-biodegradable, or are not economically producible. It is apparent, therefore, that the provision of novel surfactants possessing desired commercial requisites discussed above fulfills a recognized need in the detergent industry.

SUMMARY OF THE INVENTION

Accordingly, it is an object of the present invention to provide novel surfactant intermediates and novel surfactants. A further object of the invention is to provide novel surfactants which are biodegradable and exhibit good detergency characteristics even when combined with only relatively low amounts of detergency builders or with non-phosphate builders or builders of reduced phosphate content. Still another object of the invention is to provide novel detergent formulations based on such surfactants.

The intermediate compounds of this invention are alkane vicinal alkyl ether monohydroxy alcohols which are sulfated to form effective surfactants.

The invention will be better understood from the following description of the preferred embodiments.

DESCRIPTION OF THE PREFERRED EMBODIMENTS

The surfactant intermediates and surfactants of this invention are represented by the formula

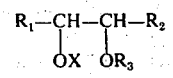

wherein $R_1$ and $R_2$ are hydrogen or primary linear alkyl groups at least one of $R_1$ or $R_2$ being an alkyl group. $R_3$ is an alkyl group containing from 1 to 4, preferably 1, carbon atoms and the total number of carbon atoms in $R_1$, $R_2$ and $R_3$ is from 13–22.

X is either hydrogen, in which case the compound is a surfactant intermediate, or $OSO_3M$ (M being an alkali metal, preferably sodium or ammonium) in which case the compound is a surfactant useful in cleansing applications including liquid detergents and dishwashing compositions, heavy duty laundry detergents, hard surface cleaning compositions and the like. The sulfonate compounds are also effective defloculating agents.

The vicinal positioning of the hydroxy or sulfonate and alkyl ether substituents and the limitations specified with respect to the carbon atom content of $R_1$, $R_2$ and $R_3$ are essential to provide desired detergency.

The vicinally positioned substituents can occupy either terminal (1,2) carbon atoms of the alkane backbone or more centrally located carbon atoms. Normally, a mixture of isomers will be present.

The alkane vicinal alkyl ether monohydroxy alcohol surfactant intermediates can be prepared by reacting an epoxide with an appropriate monohydroxy alcohol in the presence of an acidic catalyst, preferably sulfuric acid in accordance with the following reaction:

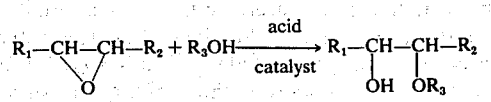

wherein $R_1$, $R_2$ and $R_3$ are as previously defined.

The product is converted to the corresponding sulfonic acid by conventional procedures, e.g., reaction with $H_2SO_4$, and neutralized with an alkali metal base or ammonia to form the detergent sulfate.

Particularly preferred surfactant intermediates and compositions of this invention are mixtures of such compounds wherein $R_3$ is methyl, $R_1$ and $R_2$ are hydrogen or primary linear alkyl groups containing from 1 to 15 carbon atoms, at least one of $R_1$ or $R_2$ being an alkyl group and the total number of carbon atoms in $R_1$ and $R_2$ being 14 to 15.

These preferred mixtures are further particularly characterized in that the weight ratio of compounds in which the number of carbon atoms in $R_1$ and $R_2$ is 14 to compounds in which the number of carbon atoms in $R_1$ and $R_2$ is 15 is from 1:4 to 3:2.

It is unexpectedly found that in certain applications, e.g., low temperature laundry operations, that the sulfate forms of such mixtures provides performance superior to either component of the mixture alone.

In view of the difficulty of economically obtaining raw materials strictly limited to the desired chain length (16–17 carbon atom alkane "backbone") these preferred compositions will normally contain minor amounts of higher and lower homologs. Preferably, at least 75%, most preferably at least 90% of the compounds will be of the chain length specified ($R_1$ and $R_2$ containing a total of 14 or 15 carbon atoms).

The novel detergent formulations of this invention comprise the above-described surfactants in combination with a detergency builder.

The amount of surfactant present in the detergent formulations, can vary depending on the end product performance desired. However, it is preferred that the range of detergent active to builder weight ratio be from about 1:10 to about 10:1, and more preferably from about 1:7 to about 1:1. The detergent formulation should contain at least 2% by weight of the surfactant of this invention.

Any of the well known detergency builders employed in combination with conventional surfactants to provide enhanced cleansing performance can be utilized. For example, alkaline water-soluble inorganic salts such as trisodium phosphate and tripotassium phosphate; dialkali metal hydrogen phosphates such as disodium hydrogen phosphate and dipotassium hydrogen phosphate; the alkaline water-soluble molecularly dehydrated alkali metal phosphate salts such as the alkali metal pyrophosphates, for example, tetrasodium pyrophosphate, tetrasodium hydrogen pyrophosphate and tetrapotassium pyrophosphate, also the alkali metal tripolyphosphates such as sodium tripolyphosphate ($Na_5P_3O_{10}$) and potassium tripolyphosphate; the water-soluble alkali metal metaphosphates such as sodium hexametaphosphate; the water-soluble alkali metal silicates such as sodium silicate having an $Na_2O$ to $SiO_2$ mole ratio of 1:1 to 1:3.6, preferably 1:1 to 1:3.5 and the corresponding potassium silicates; the water-soluble alkali metal borates such as calcined sodium tetraborate or borax; and the water-soluble alkali metal carbonates or bicarbonates such as sodium or potassium carbonates; or sodium sulfate may be utilized.

Examples of organic builders that can advantageously be employed include the amino polycarboxylate acids and salts such as the sodium potassium and ammonium salts of nitrilotriacetic acid (trisodium nitrilotriacetate), the sodium potassium and ammonium salts of amino tri(methylene phosphonic acid), as well as the free acid; and the diphosphonic acids and salts (methylene diphosphonic acid and 1-hydroxy, ethylidene diphosphonic acid). There may also be included builders such as the water-soluble salts of polymeric aliphatic polycarboxylic acids such as sodium polymaleate, sodium polyitaconate, sodium (ita-conate-aconitate) copolymer, sodium (itaconate-acrylate) copolymer, sodium (ethylene-maleate) copolymer, sodium (ethylene-maleate) copolymer (cross-linked), sodium (vinylmethylether-maleate) copolymer, and sodium (isobutylene-maleate) copolymer as disclosed and described in U.S. Pat. No. 3,308,067 which is incorporated herein by reference, aa synergistic builder combination, as disclosed and described in U.S. Pat. No. 3,368,978, which is also incorporated herein by reference, and mixtures thereof.

If desired, supplementary surfactants such as well known natural soaps or synthetic anionic, non-ionic, zwitterionic or amphoteric may be utilized. It is preferred, when using the "supplemental" actives, that there by a weight ratio of novel surface active compositions of this invention to the foregoing described supplementary actives of from about at least 1:1 to about 50:1.

The detergent formulations incorporating or embodying the novel compositions of the present invention may contain any of the usual adjuvants, diluents and additives, for example, perfumes, antitarnishing agents, anti-redeposition agents, bacteriastatic agents, dyes, fluorescent agents, suds builders, suds depressors, foam stabilizers and the like.

The detergent formulations of the present invention can be prepared by any of the well known methods in order to yield desirable composition forms such as bar, granular, flake, liquid and tablet forms. It is to be understood that this invention is not limited to any particular method of preparing the detergent formulations containing the organic and/or inorganic builder and the detergent-active (i.e., both the novel compositions and "supplemental" detergent-actives). The builder, for example, may be mechanically mixed, or slurried or dissolved in a solution of the other ingredients of the formulations. In addition, the detergent-active (as heretofore defined) may be admixed with the builder in any of the forms in which the builder is present as well as being added siimultaneously or separately to an aqueous solution containing the builder and/or other ingredients.

To more fully illustrate the most preferred embodiment of the subject invention, the following detailed examples are presented. All parts, percentages and proportions are by weight unless otherwise indicated.

EXAMPLE I

Detergent formulations are prepared containing 20% alkane vicinal methyl ether sulfates; 10% sodium carbonate; 10% sodium silicate; balance sodium sulfate. The homolog distribution of surfactant in each formulation is indicated in Table I below. The formulations are used at 0.15% concentration in water of 100 ppm hardness at 70°F to wash uniformly soiled cottom samples. The difference in reflectance of washed and unwashed samples is reported in Table I as ΔRd. The higher ΔRd values are indicative of superior detergency.

TABLE I

| Formulation No. | Weight Percent Surfactant Compounds wherein $R_1$ and $R_2$ contain | | ΔRd |
|---|---|---|---|
| | 14 carbon atoms | 15 carbon atoms | |
| 1 | 100% | 0% | 15.3 |
| 2 | 80% | 20% | 15.3 |
| 3 | 60% | 40% | 16.9 |
| 4 | 40% | 60% | 17.9 |
| 5 | 20% | 80% | 16.7 |
| 6 | 0% | 100% | 15.1 |

The superiority of formulations 3, 4 and 5 which are representative of the most preferred invention is apparent from the foregoing data. All the formulations exhibit effective performance.

EXAMPLE II

Detergent formulations are prepared using surfactant sulfates of this invention having the carbon atom contents and M constituents as shown in Table II below. For comparison, otherwise identical formulations containing a commercial alcohol ethoxylate sulfate which is a sulfate of a condensate of a linear primary alcohol containing 12 to 15 carbon atoms with 3 molecular proportions of ethylene oxide. The formulations contain 30% surfactant, 5% alkanolamide foam stabilizer and 65% water. Dishwashing tests are conducted in which plates uniformly coated with "Crisco" grease are washed in water of 46°C temperature having hardness and detergent concentration as shown in Table II. The number of plates washed prior to foam collapse is indicated.

TABLE II

| Test No. | Surfactant | Carbon Atoms In $R_1$ and $R_2$ | Carbon Atoms In $R_3$ | M | % Detergent | Hardness | Plate Washed |
|---|---|---|---|---|---|---|---|
| 1 | Alkane vicinal alkyl ether sulfate | 12 | 1 | Na | 0.15 | 150 ppm | 13 |
| 2 | Alkane vicinal alkyl ether sulfate | 14 | 3 | Na | 0.15 | 150 ppm | 21 |
| 3 | Alkane vicinal alkyl ether sulfate | 16 | 3 | Nu | 0.15 | 150 ppm | 22 |
| 4 | Alkane vicinal alkyl ether sulfate | 16 | 1 | Na | 0.15 | 150 ppm | 26 |
| 5 | Alcohol ethoxylate sulfate alkane vicinal alkyl ether sulfate + linear alkylbenzene sulfonate (1:1 weight ratio) | — | — | Na | 0.15 | 150 ppm | 20 |
| 6 | " | 12 | 1 | Na | 0.15 | 150 ppm | 29 |
| 7 | " | 14 | 3 | Na | 0.15 | 150 ppm | 33 |
| 8 | " | 16 | 3 | Na | 0.15 | 150 ppm | 27 |
| 9 | " | 16 | 1 | Na | 0.15 | 150 ppm | 35 |
| 10 | Alcohol ethoxylate sulfate linear alklbenzene sulfonate (1:1 weight ratio) | — | — | Na | 0.15 | 150 ppm | 26 |

The foregoing data demonstrates the effectiveness of the surfactants of this invention alone and in combination with other surfactants.

What is claimed is:

1. A composition comprising at least 75% by weight of a mixture of compounds represented by the formula

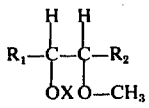

wherein X is selected from the group consisting of hydrogen and $SO_3M$, the X group being the same in substantially all of said compounds, wherein M is selected from the group consisting of alkali metals and ammonium, and $R_1$ and $R_2$ are each selected from the group consisting of hydrogen and linear alkyl groups containing from 1 to 15 carbon atoms, at least one of $R_1$ and $R_2$ being an alkyl group and the total number of carbon atoms in $R_1$ and $R_2$ being from 14 to 15 and the weight ratio of compounds in which the number of carbon atoms in $R_1$ and $R_2$ is 14 to compounds in which the number of carbon atoms in $R_1$ and $R_2$ is 15 being from 1:4 to 3:2.

2. The composition of claim 1 wherein X is $SO_3M$.

3. A detergent formulation consisting essentially of, as a surfactant, at least 2% by weight of a mixture of alkane vicinal methyl ether sulfate compounds represented by the formula

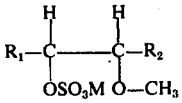

wherein M is selected from the group consisting of alkali metals and ammonium and $R_1$ and $R_2$ are each selected from the group consostomg of hydrogen and linear alkyl groups containing from 1 to 15 carbon atoms, at least one of $R_1$ and $R_2$ being an alkyl group and the total number of carbon atoms in $R_1$ and $R_2$ being from 14 to 15 and the weight ratio of compounds in which the number of carbon atoms in $R_1$ and $R_2$ is 14 to compounds in which the number of carbon atoms in $R_1$ and $R_2$ is 15 being from 1:4 to 3:2 and a detergency builder, the ratio of surfactant to detergency builder being from about 10:1 to about 1:10.

* * * * *